US007412785B1

(12) United States Patent
Navasky

(10) Patent No.: US 7,412,785 B1
(45) Date of Patent: Aug. 19, 2008

(54) DECORATIVE VAMP SYSTEM

(76) Inventor: Edward Navasky, 309 School St., Philipsburg, PA (US) 16866

( * ) Notice: Subject to any disclaimer, the term of this patent is extended or adjusted under 35 U.S.C. 154(b) by 421 days.

(21) Appl. No.: 10/907,353

(22) Filed: Mar. 30, 2005

Related U.S. Application Data

(63) Continuation-in-part of application No. 10/711,344, filed on Sep. 13, 2004, now Pat. No. 7,331,128.

(51) Int. Cl.
*A43B 3/24* (2006.01)

(52) U.S. Cl. ..... 36/100; 36/45; 36/136

(58) Field of Classification Search ..... 36/100, 36/101, 136, 45
See application file for complete search history.

(56) References Cited

U.S. PATENT DOCUMENTS

| | | | | | |
|---|---|---|---|---|---|
| 2,444,640 | A * | 7/1948 | Epstein | 36/101 |
| 2,801,477 | A * | 8/1957 | Adams et al. | 40/636 |
| 2,887,792 | A * | 5/1959 | Staff | 36/100 |
| 3,032,896 | A * | 5/1962 | Weaver | 36/101 |
| 3,119,191 | A * | 1/1964 | Vitzthum | 36/84 |
| 3,972,136 | A * | 8/1976 | Epstein | 36/101 |
| 3,994,080 | A * | 11/1976 | Flanagan et al. | 36/100 |
| 3,999,311 | A * | 12/1976 | Epstein | 36/100 |
| 4,516,337 | A * | 5/1985 | Adamik | 36/136 |
| 4,852,276 | A * | 8/1989 | Savoca et al. | 36/136 |
| 4,955,150 | A * | 9/1990 | Fagan | 36/136 |
| 5,065,531 | A * | 11/1991 | Prestridge | 36/100 |
| 5,659,979 | A * | 8/1997 | Sileo | 36/54 |
| 5,778,564 | A * | 7/1998 | Kettner | 36/101 |
| 6,115,948 | A * | 9/2000 | Mitchell | 36/136 |
| 6,212,797 | B1 * | 4/2001 | Merry et al. | 36/101 |
| 6,874,256 | B2 * | 4/2005 | Delgatty | 36/100 |
| 2002/0029494 | A1 * | 3/2002 | Small | 36/54 |
| 2003/0192205 | A1 * | 10/2003 | Linens | 36/100 |
| 2004/0172853 | A1 * | 9/2004 | Tonkel | 36/100 |

* cited by examiner

*Primary Examiner*—Marie Patterson
(74) *Attorney, Agent, or Firm*—John J. Elnitski, Jr.

(57) ABSTRACT

A decorative vamp system for shoes. The decorative vamp system allows the appearance of the vamp of a shoe to be changed to match the clothing of the wearer. The decorative vamp system includes the shoe with a fixed vamp, a removable vamp insert, a tongue flap and a receiving lip. The removable vamp insert is held in place by the receiving lip and the tongue flap. The removable vamp insert is removable from the shoe to allow changing of the appearance of the vamp of the shoe. Additional materials can be used between the removable vamp insert and the fixed vamp to provide a frictional force between the removable vamp insert and the fixed vamp to further hold the removable vamp insert in place.

16 Claims, 10 Drawing Sheets

DECORATIVE VAMP SYSTEM

BACKGROUND

The present invention generally relates to shoes. More specifically, the present invention relates to a system providing for a removable shoe vamp.

Shoes are considered an important accessory to clothing. Shoes can be purchased in a plain variety or can be purchased in a stylized variety. The plain variety of shoe can be coordinated with different clothing. The stylized variety of shoe is usually limited to be wore with only certain clothing in a wardrobe. Clothing and shoes are expensive to purchase, so most purchases are limited to plain varieties which can be coordinated with each other. What is needed is a stylized shoe which can be changed depending on the clothing to be wore.

It is an object of the present invention to provide system for a shoe with a removable vamp.

SUMMARY OF THE INVENTION

A decorative vamp system for shoes. The decorative vamp system allows the appearance of the vamp of a shoe to be changed to match the clothing of the wearer. The decorative vamp system includes the shoe with a fixed vamp, a removable vamp insert, a tongue flap and a receiving lip. The removable vamp insert is held in place by the receiving lip and the tongue flap. The removable vamp insert is removable from the shoe to allow changing of the appearance of the vamp of the shoe. Additional materials can be used between the removable vamp insert and the fixed vamp to provide a frictional force between the removable vamp insert and the fixed vamp to further hold the removable vamp insert in place.

DETAILED DESCRIPTION

Figure 1:
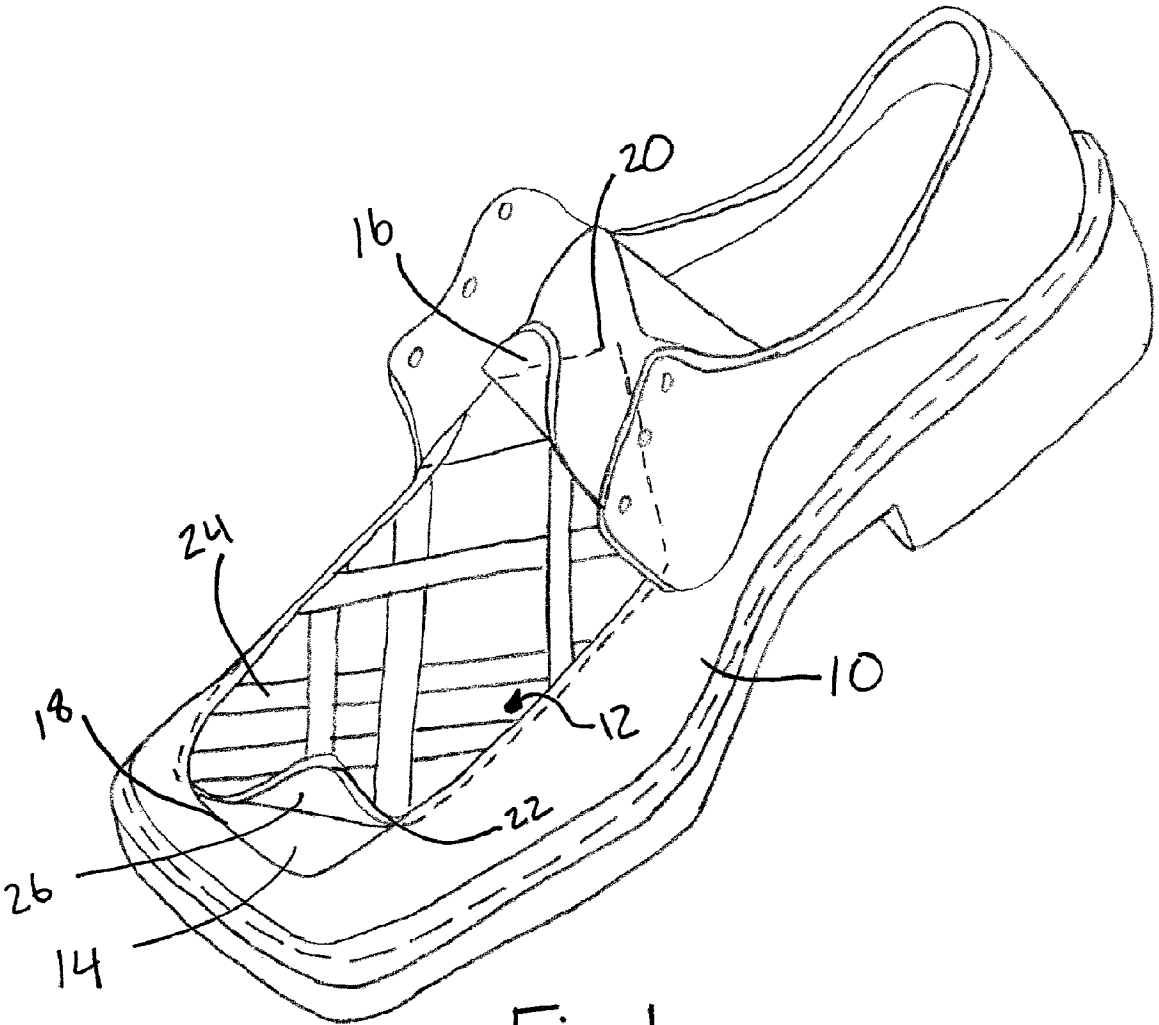
FIG. 1 is a perspective view of a shoe with a removable vamp according to the present invention.
Figure 2:
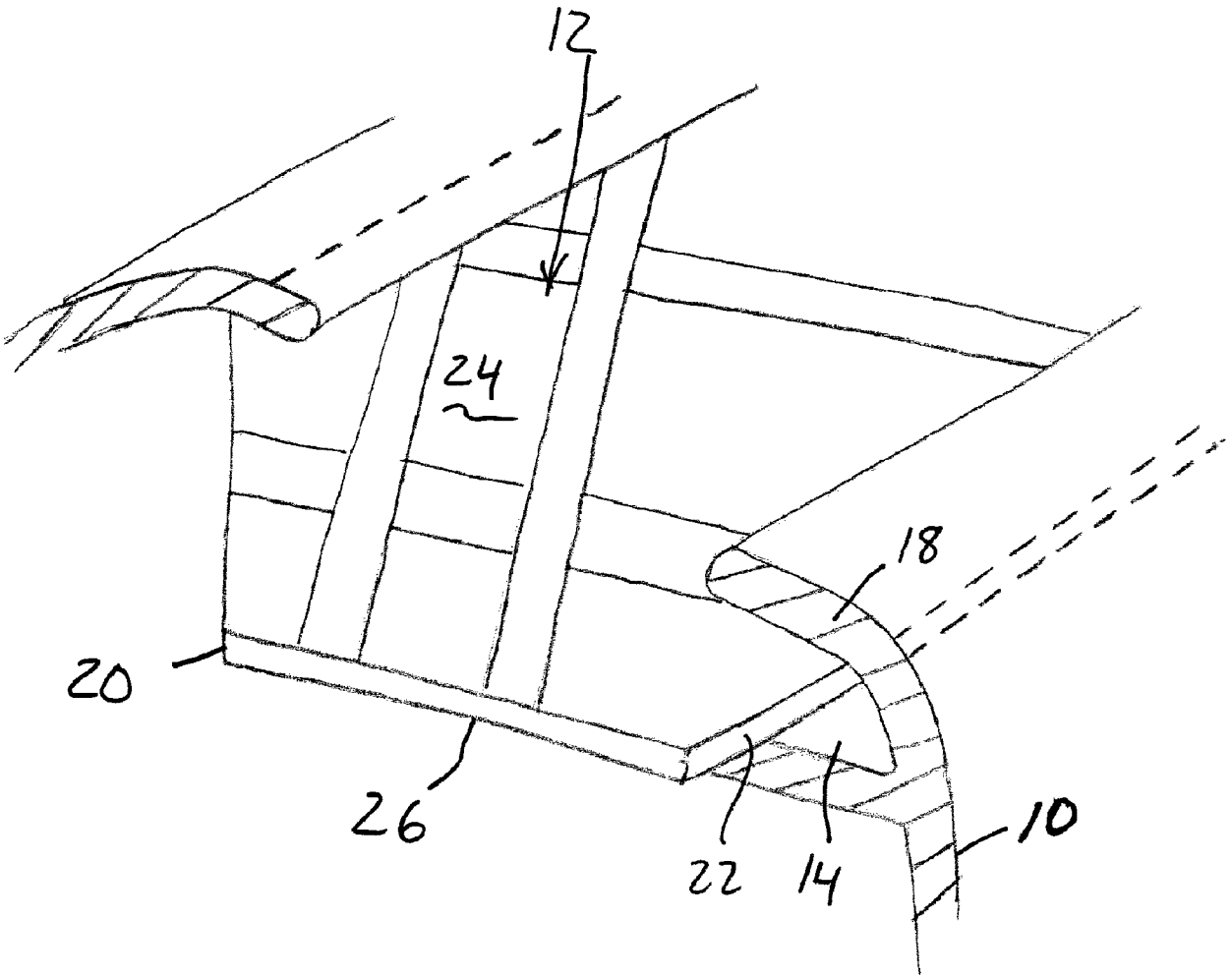
FIG. 2 is a perspective view of a secured removable vamp of the shoe of FIG. 1 according to the present invention.

The present invention is a decorative vamp system for shoes. The decorative vamp system allows the appearance of the vamp of a shoe to be changed to match the clothing of the wearer. FIGS. 1-6 show a shoe 10 with a removable vamp insert 12. The shoe 10 of FIGS. 1-2 includes a fixed vamp 14, the removable vamp insert 12, a tongue flap 16 and a receiving lip 18. FIG. 1 shows the removable vamp insert 12 being held in place on the shoe 10 by the receiving lip 18. FIG. 2 shows a close up of the receiving lip 18 looking from the tongue area downward. The removable vamp insert 12 includes a tongue end 20 which fits under the tongue flap 16. The tongue flap 16 is a piece of material attached to the tongue of the shoe 10 to hold the removable vamp insert 12 in place. The removable vamp insert 12 is placed over the fixed vamp 14 with an outside edge 22 of the removable vamp insert 12 placed into the receiving lip 18 and with the tongue end 20 placed under the tongue flap 16. The fixed vamp 14 can be decorative in nature, such as an alligator skin pattern. A decorative fixed vamp allows use of the shoe 10 without the removable vamp insert 12. The removable vamp insert 12 has an outside layer 24 and an inside layer 26. The outside layer 24 is a decorative layer, which could be anything from a fabric material to a leather material. The inside layer 26 is the part of the removable vamp insert 12 which contacts the fixed vamp 14. The inside layer 26 could be a material which provides a frictional force between the inside layer 26 and the fixed vamp 14 to prevent movement of the removable vamp insert 12. The removable vamp insert 12 can be used with the shoe 10 of FIG. 1 without a tongue flap 16.

Figure 3:
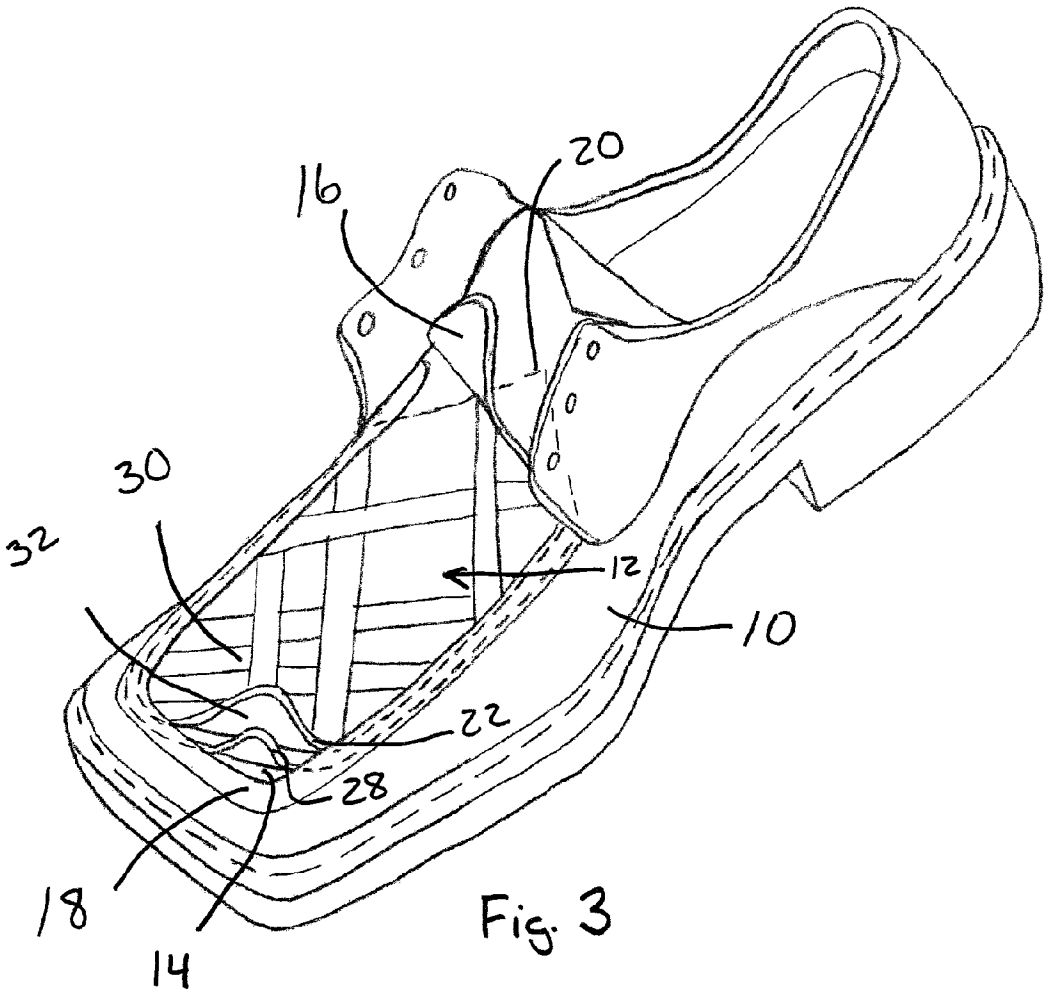
FIG. 3 is a perspective view of another shoe with a removable vamp according to the present invention.
Figure 4:
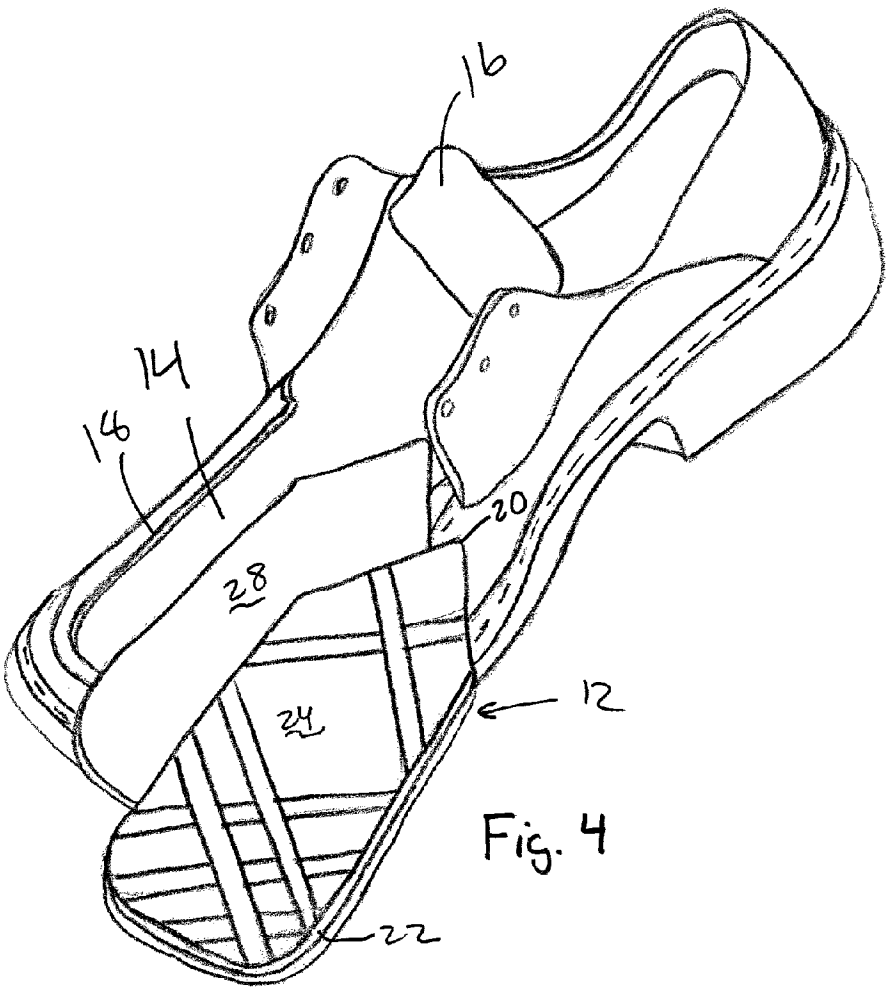
FIG. 4 is an exploded of the shoe of FIG. 3 according to the present invention.
Figure 5:
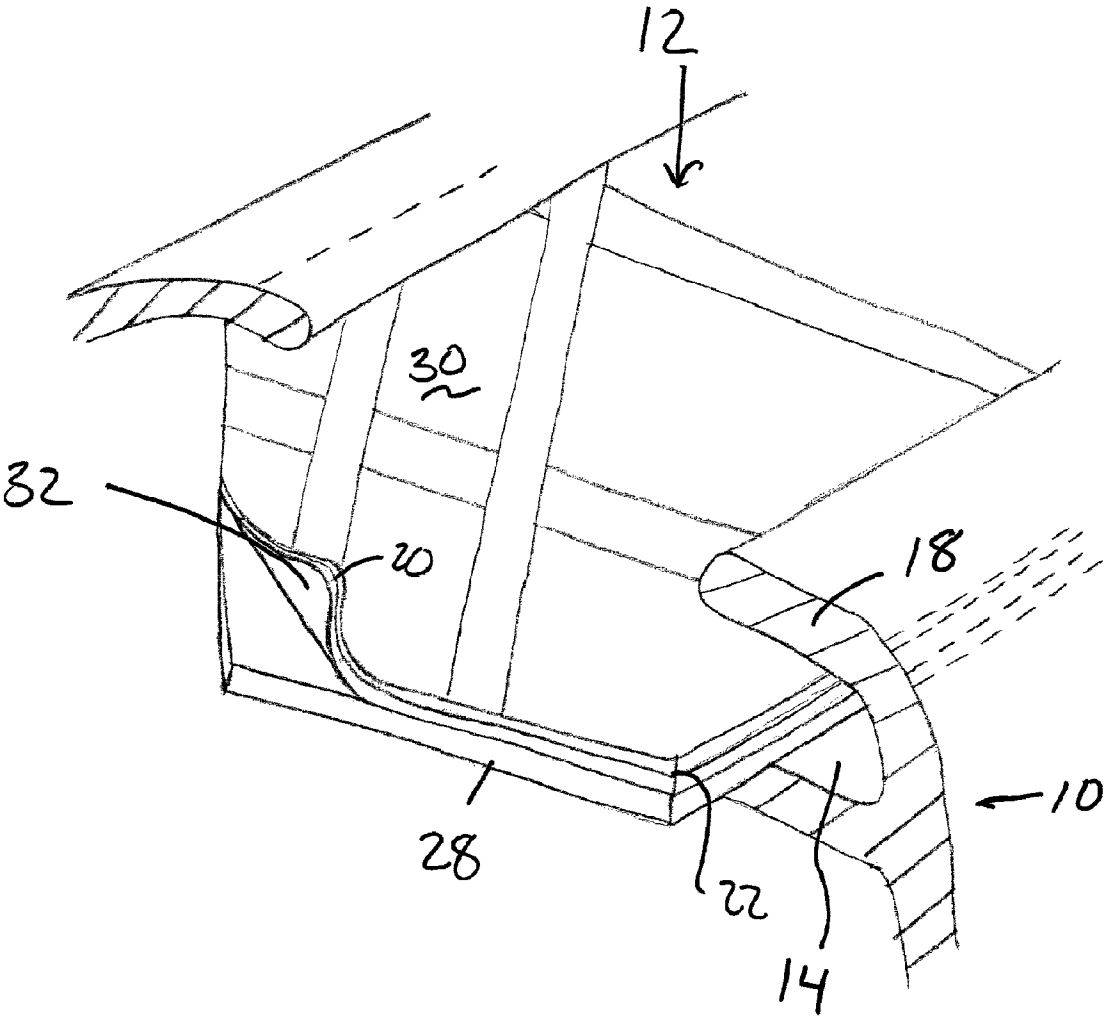
FIG. 5 is a perspective view of a secured removable vamp of the shoe of FIG. 3 according to the present invention.

The shoe of FIGS. 3-5 includes the fixed vamp 14, a magnetic sheet 28, the removable vamp insert 12, the tongue flap 16 and the receiving lip 18. FIG. 4 shows an exploded view of the magnetic sheet 28 and the removable vamp insert 12. FIG. 3 shows the removable vamp insert 12 being held in place on the shoe 10 by the receiving lip 18. FIG. 5 shows a close up of the receiving lip 18 looking from the tongue area downward. FIGS. 3-5 show the addition of the magnetic sheet 28 attached to the fixed vamp 14. In most cases, the magnetic sheet 28 will be permanently mounted to the fixed vamp 14 or formed as part of the fixed vamp 14. The removable vamp insert 12 includes the tongue end 20 which fits under the tongue flap 16. The tongue flap 16 is a piece of material attached to the tongue of the shoe 10 to hold the removable vamp insert 12 in place. The removable vamp insert 12 is placed over the magnetic sheet 28 with the outside edge 22 of the removable vamp insert 12 placed into the receiving lip 18 and with the tongue end 20 placed under the tongue flap 16. The removable vamp insert 12 has an outside layer 30 and an inside layer 32. The outside layer 30 is a decorative layer, which could be anything from a fabric material to a leather material. The inside layer 32 is the part of the removable vamp insert 12 which contacts the magnetic sheet 28 and is a magnetic material which is attracted to the magnetic sheet 28. The magnetic sheet 28 and inside layer 32 of the removable vamp insert can be replaced with attractive materials, such as hook and loop materials. The removable vamp insert 12 can be used with the shoe of FIGS. 3-4 without a tongue flap 16.

Figure 6:
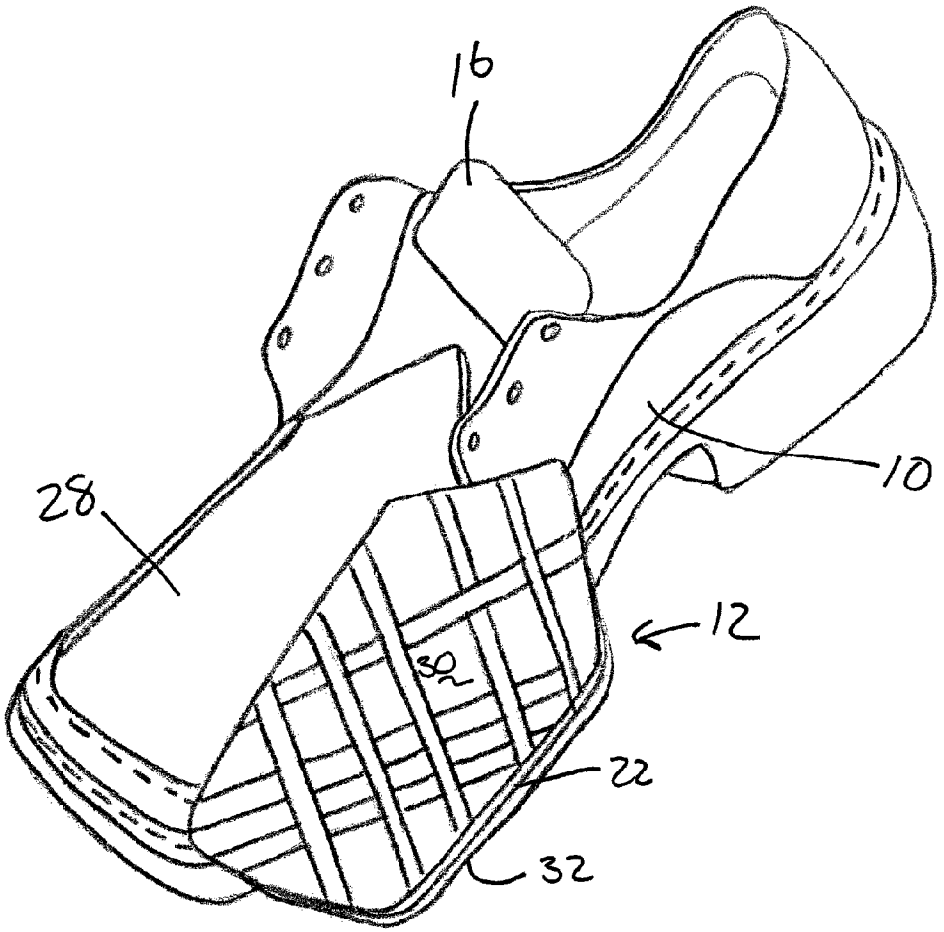
FIG. 6 is a perspective view of another shoe with a removable vamp according to the present invention.

The shoe of FIG. 6 includes the fixed vamp 14, the magnetic sheet 28, the removable vamp insert 12, and the tongue flap 16. There is no receiving lip 18 to hold the removable vamp insert 12 in FIG. 6. FIG. 6 shows the magnetic sheet 28 attached to the fixed vamp 14. In most cases, the magnetic sheet 28 will be permanently mounted to the fixed vamp 14 or formed as part of the fixed vamp 14. The removable vamp insert 12 includes the tongue end 20 which fits under the tongue flap 16. The tongue flap 16 is a piece of material attached to the tongue of the shoe 10 to hold the removable vamp insert 12 in place. The removable vamp insert 12 is placed over the magnetic sheet 28 and with the tongue end 20 placed under the tongue flap 16. The removable vamp insert 12 has the outside layer 30 and the inside layer 32. The outside layer 30 is a decorative layer, which could be anything from a fabric material to a leather material. The inside layer 32 is the part of the removable vamp insert 12 which contacts the magnetic sheet 28 and is a magnetic material which is attracted to the magnetic sheet 28. The magnetic sheet 28 and inside layer 32 of the removable vamp insert 12 can be replaced with attractive materials, such as hook and loop materials. The removable vamp insert 12 can be used with the shoe 10 of FIG. 6 without a tongue flap 16.

Figure 7:
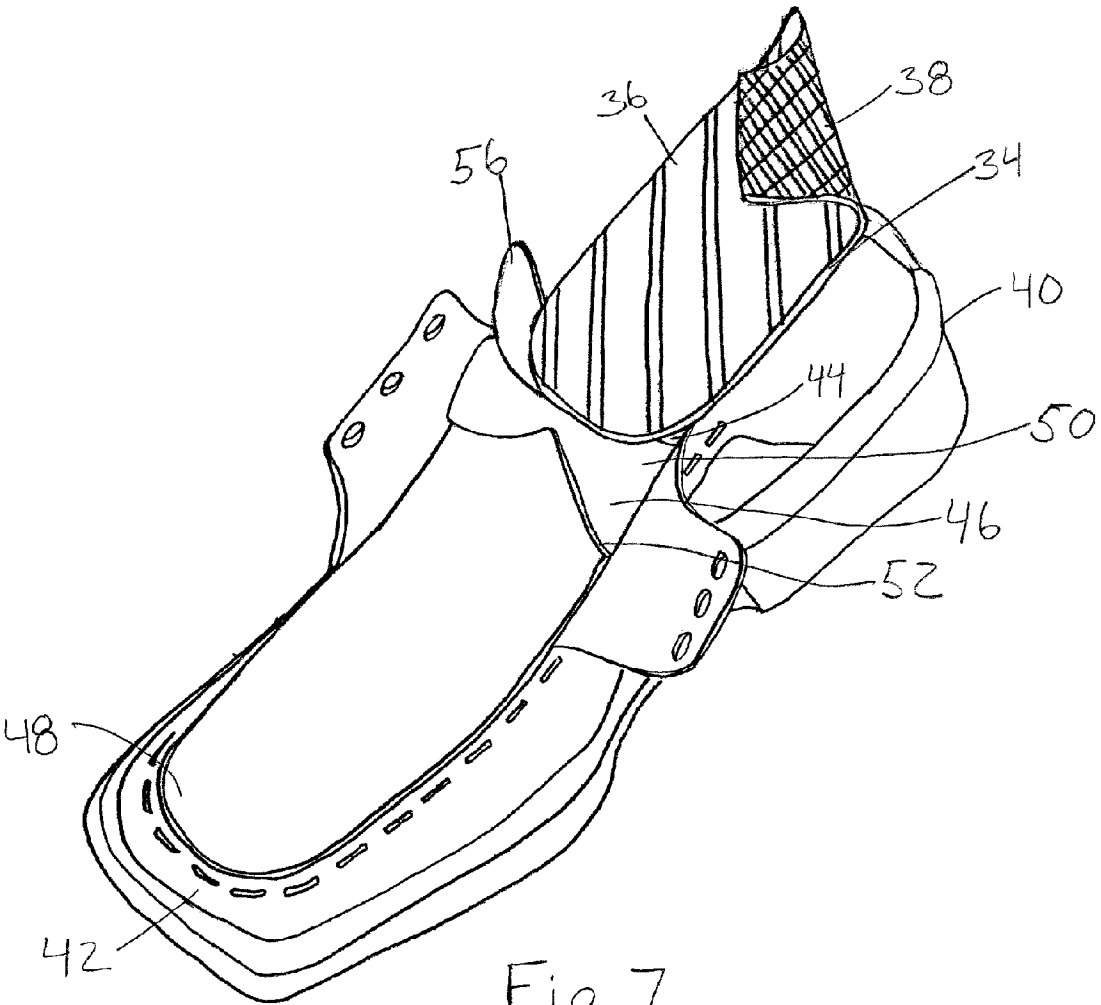
FIG. 7 is a perspective view of another shoe with a removable vamp according to the present invention.
Figure 8:
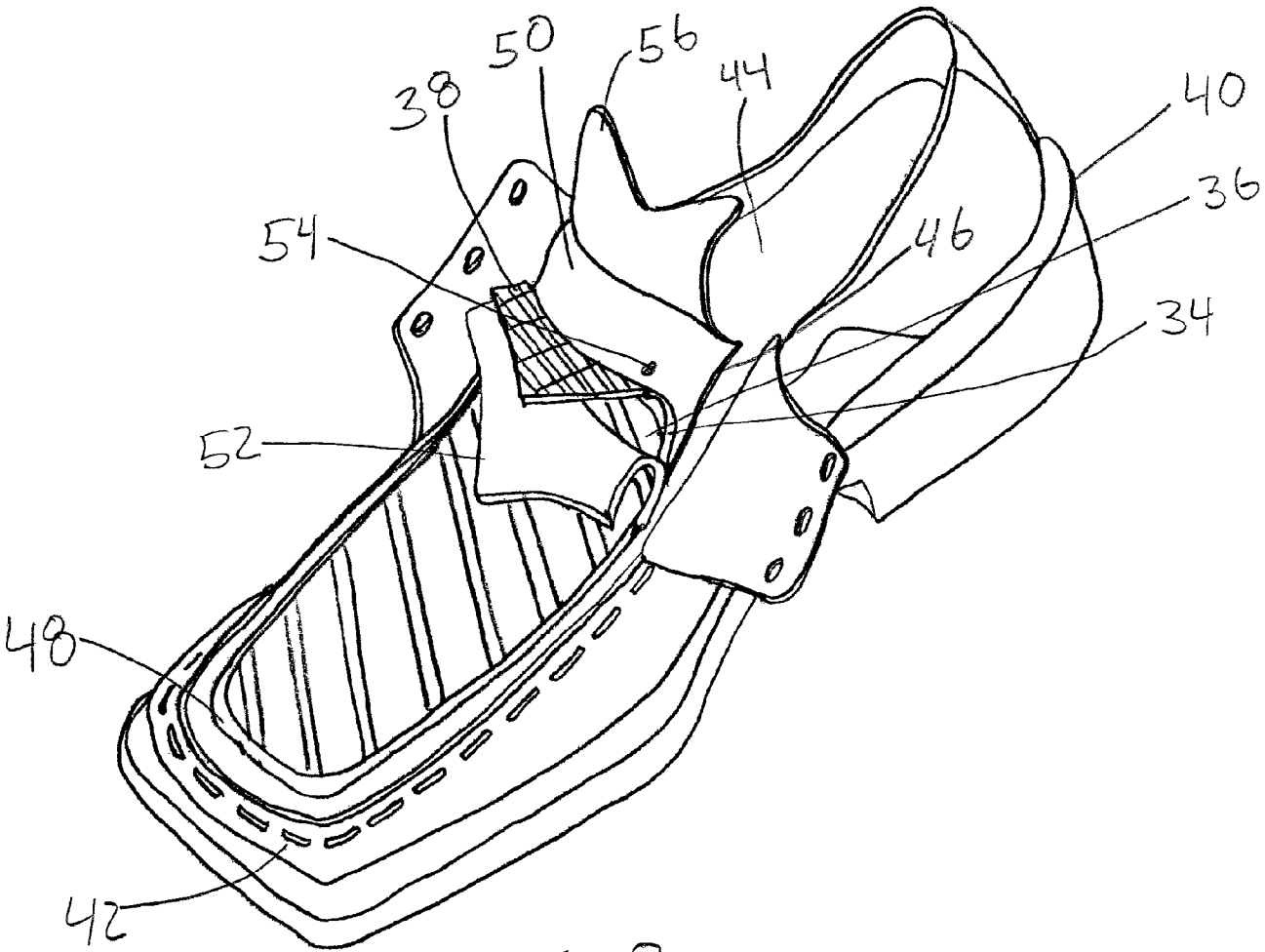
FIG. 8 is a perspective view of the shoe of FIG. 7 according to the present invention.
Figure 9:
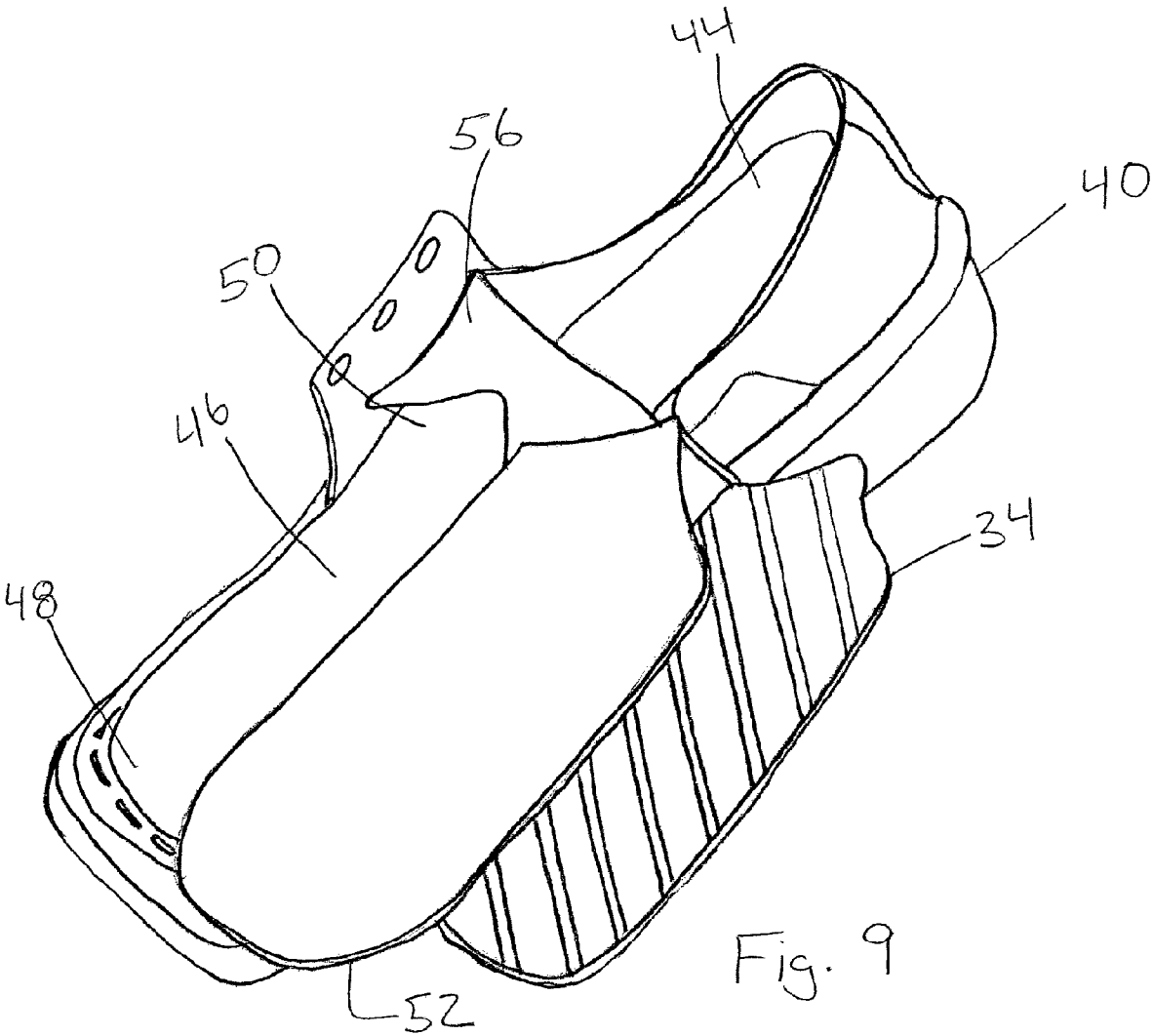
FIG. 9 is an exploded of the shoe of FIG. 8 according to the present invention.

FIGS. 7-8 show an embodiment of a reversible removable vamp insert 34. The reversible removable vamp insert 34 is similar to the above described removable vamp insert 12. The difference between them is that the outside layer 36 and the inside layer 38 of the reversible removable vamp insert 34 are each a decorative layer to match the clothing of the wearer. The reversible removable vamp insert 34 is therefore reversible. The decorative layer on both the inside layer 38 and outside layer 36 can be of a different design and or material to add flexibility to the wearer's wardrobe. The inside layer 38 and outside layer 36 are shown in FIGS. 7-8 as different designs.

Figure 10:
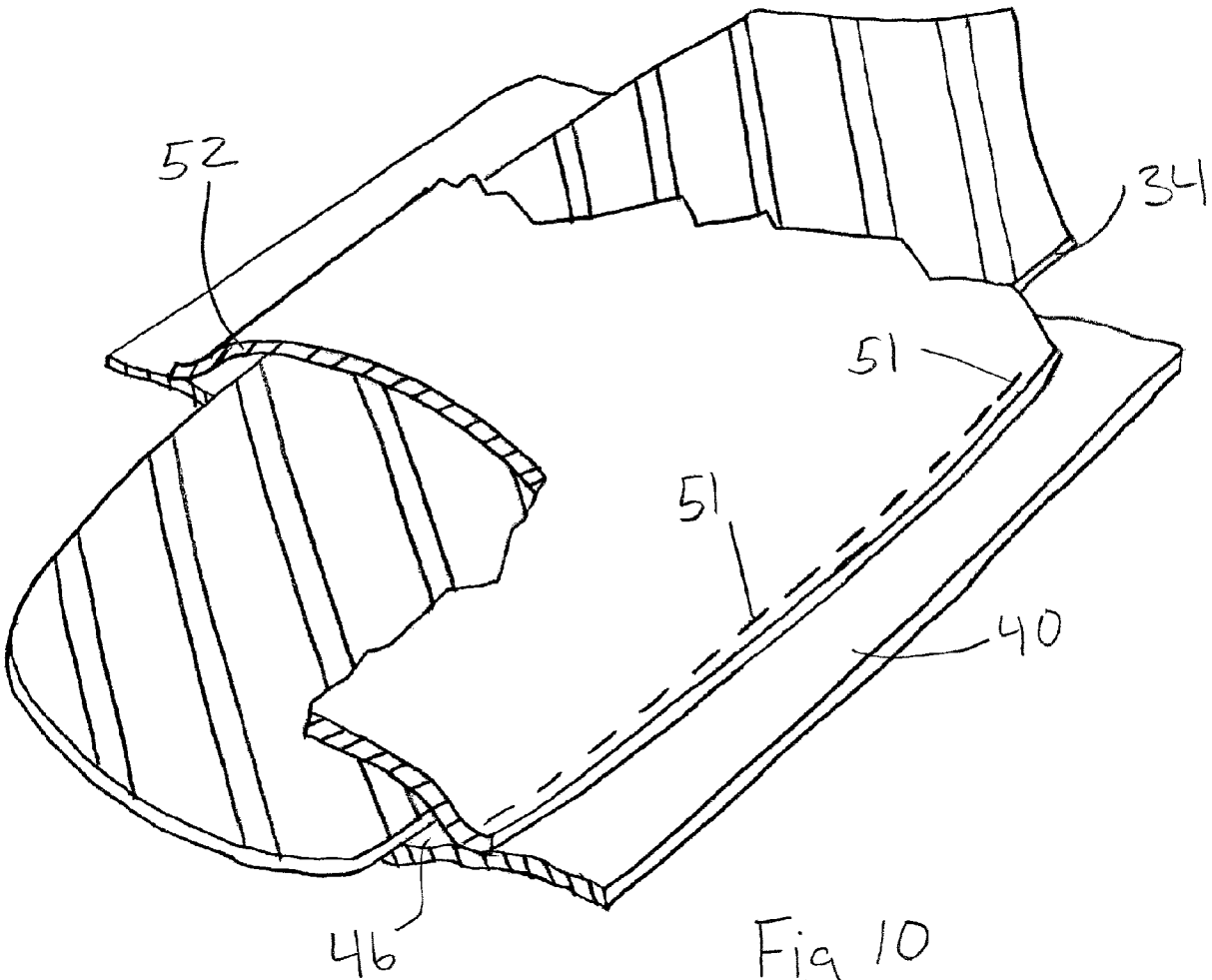
FIG. 10 is a partial close up view of the shoe of FIG. 8 according to the present invention.

FIGS. 7-10 show another embodiment of the decorative vamp system on a shoe 40 having a toe 42 and a foot entrance 44. The shoe 40 includes a fixed vamp 46 with a toe end 48 near the toe 42 of the shoe 40 and a tongue end 50 near the foot entrance 44 of the shoe 40. The embodiment of FIGS. 7-10 includes a clear vamp retainer 52 and a removable vamp insert illustrated by the reversible removable vamp insert 34. The clear vamp retainer 52 is made of a clear see-thru material. The clear vamp retainer 52 is mounted to the shoe 40 over the fixed vamp 46 of the shoe 40, such that together the fixed vamp 46 and the clear vamp retainer 52 form a empty area to receive the reversible removable vamp insert 34. The clear vamp retainer 52 shown in FIG. 10 is sewn with stitches 51 to the shoe 40, but it also could be glued or other wise attached to the shoe 40. The clear vamp retainer 52 includes an insert opening 54 at the tongue end 48 of the fixed vamp 46 to allow insertion of the reversible removable vamp insert 34 between the fixed vamp 46 and the clear vamp retainer 52. The shoe is shown with a tongue flap 56.

While different embodiments of the invention have been described in detail herein, it will be appreciated by those skilled in the art that various modifications and alternatives to the embodiments could be developed in light of the overall teachings of the disclosure. Therefore, any combination of the components show in FIGS. 1-10 can be mixed and matched to provide a show using the decorative vamp system. Accordingly, the particular arrangements are illustrative only and are not limiting as to the scope of the invention that is to be given the full breadth of any and all equivalents thereof.

What is claimed is:

1. A decorative vamp system comprising:

a removable vamp insert; and a shoe with a toe, heel, foot entrance, sole, two sides extending up from the sole and a fixed vamp fixed along said sides and fixed along said toe and being between said toe said foot entrance;

a clear vamp retainer mounted over said fixed vamp, said clear vamp retainer mounted to said fixed vamp such that there is an empty area to receive said removable vamp insert and said clear vamp retainer being see-thru.

2. The decorative vamp system of claim 1, wherein said clear vamp retainer is sewn to said shoe.

3. The decorative vamp system of claim 1, wherein said clear vamp retainer is glued to said shoe.

4. The decorative vamp system of claim 1, wherein said fixed vamp includes a toe end near said toe of said shoe and a tongue end near said foot entrance of said shoe; and further including an insert opening at said tongue end of said fixed vamp to allow insertion of said removable vamp insert between said fixed vamp and said clear vamp retainer.

5. The decorative vamp system of claim 1, wherein said shoe includes a tongue flap to cover one end of said clear vamp retainer.

6. The decorative vamp system of claim 2, wherein said shoe includes a tongue flap to cover one end of said clear vamp retainer.

7. The decorative vamp system of claim 3, wherein said shoe includes a tongue flap to cover one end of said clear vamp retainer.

8. The decorative vamp system of claim 4, wherein said shoe includes a tongue flap at said tongue end of said fixed vamp to cover one end of said clear vamp retainer.

9. The decorative vamp system of claim 1, wherein said removable vamp insert includes two sides, said two sides each having a decorative layer such that the removable vamp insert is reversible.

10. The decorative vamp system of claim 2, wherein said removable vamp insert includes two sides, said two sides each having a decorative layer such that the removable vamp insert is reversible.

11. The decorative vamp system of claim 3, wherein said removable vamp insert includes two sides, said two sides each having a decorative layer such that the removable vamp insert is reversible.

12. The decorative vamp system of claim 4, wherein said removable vamp insert includes two sides, said two sides each having a decorative layer such that the removable vamp insert is reversible.

13. The decorative vamp system of claim 5, wherein said removable vamp insert includes two sides, said two sides each having a decorative layer such that the removable vamp insert is reversible.

14. The decorative vamp system of claim 6, wherein said removable vamp insert includes two sides, said two sides each having a decorative layer such that the removable vamp insert is reversible.

15. The decorative vamp system of claim 7, wherein said removable vamp insert includes two sides, said two sides each having a decorative layer such that the removable vamp insert is reversible.

16. The decorative vamp system of claim 8, wherein said removable vamp insert includes two sides, said two sides each having a decorative layer such that the removable vamp insert is reversible.

* * * * *